United States Patent [19]

Samosky et al.

[11] Patent Number: 4,651,935

[45] Date of Patent: Mar. 24, 1987

[54] HORIZONTAL MEDIA MILL

[75] Inventors: Paul E. Samosky, Riverside; John J. Corrigan, Garden Grove; Dale H. Morehouse, Glendale; Edward J. Szkaradek, Santa Ana, all of Calif.

[73] Assignee: Morehouse Industries, Inc., Fullerton, Calif.

[21] Appl. No.: 663,049

[22] Filed: Oct. 19, 1984

[51] Int. Cl.[4] ..... B02C 17/16

[52] U.S. Cl. ..... 241/65; 241/69; 241/74; 241/172

[58] Field of Search ..... 241/177, 65, 66, 67, 241/172, 46.17, 171, 285 R, 285 A, 285 B, 101.2, 179, 180, 74, 69

[56] References Cited

U.S. PATENT DOCUMENTS

| | | | |
|---|---|---|---|
| 1,280,132 | 10/1918 | Ball | 241/177 X |
| 1,933,764 | 11/1933 | Ruth | 241/177 X |
| 2,991,947 | 7/1961 | Schuyler | 241/171 X |
| 3,134,549 | 5/1964 | Quackenbush et al. | 241/74 |
| 3,307,792 | 3/1967 | Hughes et al. | 241/172 X |
| 3,545,687 | 12/1970 | Mosby . | |
| 3,993,254 | 11/1976 | Bicik et al. | 241/67 |
| 4,140,283 | 2/1979 | Szkaradek . | |
| 4,441,658 | 4/1984 | Szkaradek . | |

FOREIGN PATENT DOCUMENTS

| | | | |
|---|---|---|---|
| 2030179 | 1/1979 | Fed. Rep. of Germany | 241/172 |
| 1335690 | 8/1961 | France | 241/172 |
| 977014 | 11/1982 | U.S.S.R. | 241/172 |
| 1024102 | 6/1983 | U.S.S.R. | 241/67 |

OTHER PUBLICATIONS

Drais Perl-Mill—Continuous Agitation Bead Mill, PM-TEX Series.

*Primary Examiner*—Mark Rosenbaum

*Attorney, Agent, or Firm*—Knobbe, Martens, Olson & Bear

[57] ABSTRACT

A horizontal media mill comprising a cantilevered shaft extending from a motor into a vessel in which a rotor mounted on the shaft agitates a grinding media and the product being milled. A cup-shaped screen and a cup-shaped end cover fit over the free end of the rotor and are removably mounted on the end of the vessel. The screen filters the media from the milled product as the product flows to an outlet in the end cover. The rotor is of a one-piece polymeric construction and slides off the shaft to be removable when the screen is removed. The mill is tiltable to facilitate cleaning, and includes an integrated hydraulic system which tilts the mill, cools the vessel, drives the product pump, and provides pressure for a seal where the shaft enters the vessel.

13 Claims, 3 Drawing Figures

Fig. 1
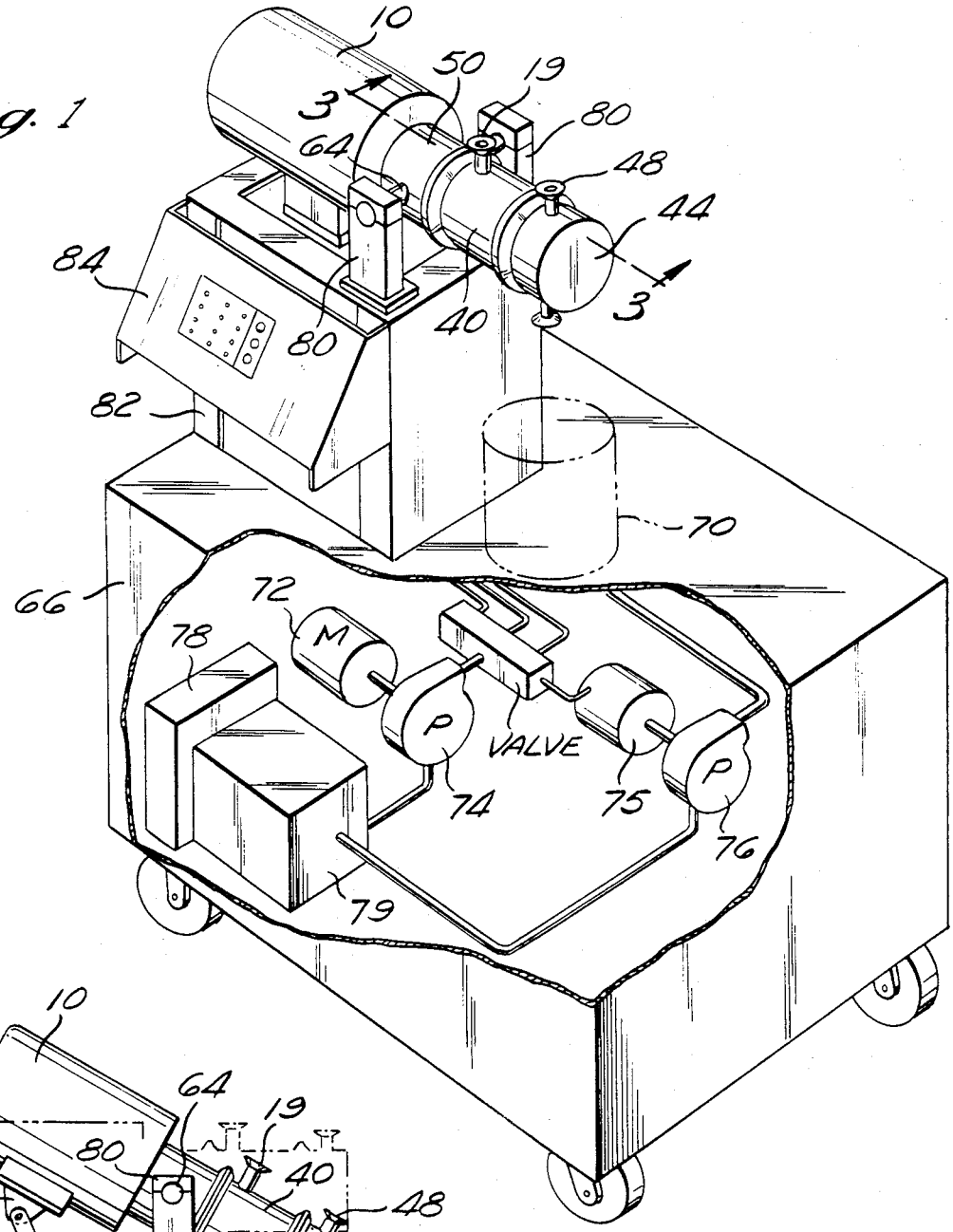
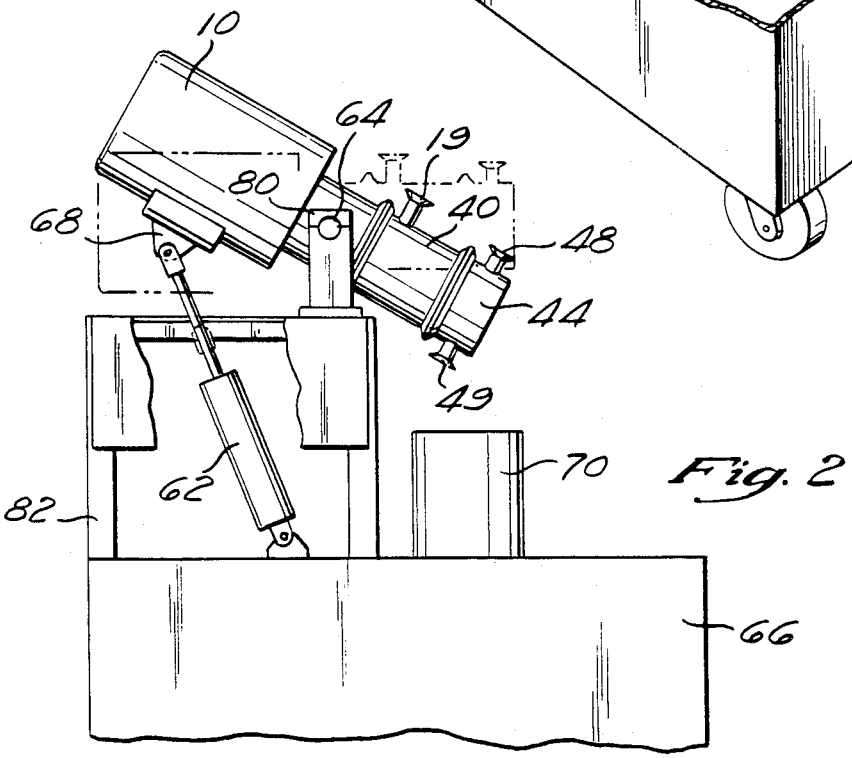
Fig. 2

HORIZONTAL MEDIA MILL

BACKGROUND OF THE INVENTION

This invention relates to an improved horizontal sandmill or media mill. Sandmilling is a proven, practical, continuous, high production method of dispersing and milling particles in a liquid to produce smooth, uniform, finely dispersed products. One use of sandmilling is to mill pigments in paints. The process is also applicable to the production of a wide variety of inks, dyestuffs, paper coatings, chemicals, magnetic tape coatings, insecticides, and other materials in which milling to a high degree of fineness/dispersion is required.

In a typical sandmilling process, the material or slurry to be processed is introduced at the bottom of a vertically oriented processing chamber or vessel and pumped upwards through a grinding media. The grinding media in years past had usually been sand, but more commonly a small diameter manufactured product of steel or other material is used as the grinding media. Rotors within the vessel agitate the slurry and the grinding media to insure proper particle reduction and dispersion of the slurry.

Typically, the processed liquid exits the vessel at the upper end of the vessel. Since the liquid product may contain suspended particles of the grinding media, generally a screen is placed at the vessel's outlet to retain the media in the mill.

While media mills having a vertical orientation, are in widespread use, horizontal mills are desired in some situations. Because of height limitations, the shaft of the motor which drives the rotor generally is parallel to the rotor itself, and requires gears or belts to drive the rotor. Also, with tail mills the motor and transmission are not readily accessible. Further, since the media gravitates toward the bottom of the vessel, wear on the rotor discs is uneven, thus requiring replacement before all are worn.

A horizontally oriented vessel requires more floor space but has some advantages. With horizontal orientation, height problems are reduced, and all of the apparatus is readily accessible. Also, the rotor wear tends to be more even in horizontal mills, since the media is distributed fairly evenly throughout the vessel. However, replacing the rotor in prior horizontal mills requires a lengthy disassembly process, as does replacing the media.

Prior vertical mills have taken advantage of the media's gravitational tendency by utilizing a dump valve at the lower end or by fastening an end plate to the open bottom end of the vessel by means of a quick disconnect ring, as disclosed in U.S. Pat. No. 4,140,283, owned by the assignee of the present invention. Removing the end plate or opening the valve allows the media to quickly drain out the bottom of the vessel for cleaning or replacement.

Since the media lays along the bottom of a horizontal vessel for the entire length of the vessel, removal of the media or access to the screen or rotor has been troublesome. Prior horizontal mills are typically formed of sections which are bolted together, and these sections must be disconnected. To access all of the media, usually results in media spilling out along the entire length of the vessel. To aid in this process, a large pan or tray may be utilized, with the result that the media must again be transferred to another container. The entire operation is messy and time consuming.

Regardless of the orientation of the vessel, prior mills have also been unsatisfactory in other respects. The screen placed at the vessel's outlet is generally a welded steel screen which becomes worn with use due to the constant contact with the grinding media, and must be frequently replaced. Replacement is a very time-consuming operation. In the event that a flammable product is being milled, the controls for the electric motor used to drive the rotor must have explosion-proof switch boxes, adding to the overall expense of the mill.

The cost and complexity of the mill may also be increased by the need for a pump to circulate coolant through a cooling jacket surrounding the vessel, to remove the heat generated by the friction of the milling process. Also, a separate pump is required to pump product through the vessel. Each pump usually means a corresponding electric motor, and therefore explosion-proof switch boxes as well.

The mill rotor is usually formed of a plurality of separate discs bolted or keyed to a shaft. This can introduce balance problems, if adequate tolerances and manufacturing accuracy are not maintained. It also requires considerable assembly labor.

Thus, a need exists for a simplified media mill which is easily cleaned, has a long lasting and easily replaceable rotor and screen, and requires fewer explosion-proof switch boxes, pumps, and electric motors.

SUMMARY OF THE INVENTION

The invention comprises an improved media mill having a horizontally oriented vessel which has a removable end cover and is tiltable to facilitate draining and cleaning of the vessel.

In one form, the novel horizontal mill has a cantilevered shaft which extends directly from the mill motor through a cylindrical vessel and protrudes out the vessel's open end. The open end of the vessel is enclosed by a cup-shaped screen assembly and surrounding end cover which are mounted on the vessel by means of a quickly removable retainer ring.

In the preferred embodiment, the screen assembly incorporates a screen element of the type disclosed in U.S. patent application, Ser. No. 6-627,918, filed July 5, 1984, (now abandoned) and assigned to the same assignee as the present invention. This screen comprises a plurality of annular discs, which are stacked to form a cylinder having a central axial opening or channel. This channel forms an extension of the vessel, and surrounds the protruding end of the rotor. Slots in the discs form a plurality of radial openings in the cylinder to allow the passage of milled product from the central axial opening to the outside of the cylinder. The product then flows through an outlet in the end cover.

Slideably mounted on the shaft is a one-piece rotor, preferably made of a wear resistant polymeric. The rotor is preferably machined from a bar of suitable material to form a cylinder surrounded by integral, axially spaced, annular discs. Prior to machining the discs, the bar is provided a central axial opening preferably having a square cross section to mate with a square cross section on the shaft. The bar is initially tabular or if not, a hole is drilled in it. The square cross section is then formed by broaching. The rotor is easily replaced by removing the end cover and screen assemblies, unfastening a retaining nut, and sliding the rotor off the end of the cantilevered shaft.

To facilitate draining and cleaning, the mill is mounted to be tilted by a hydraulic ram or other suitable means to lower the outlet end of the vessel. The ram is part of an integrated hydraulic system in the mill. The working fluid pumped into the hydraulic ram by means of a motor-driven circulator pump is also circulated through a cooling jacket which surrounds the vessel, and then through a heat exchanger. The working fluid is also used to pressurize a seal where the motor shaft enters the vessel. The pressure seal maintains an adequate pressure differential across the seal to prevent leakage while the product pumped renders pressure through the vessel. The working fluid is further utilized to power a hydraulic motor driving a product pump, eliminating the need for another electric motor.

BRIEF DESCRIPTION OF THE DRAWINGS

FIG. 1 is a perspective view of the horizontal mill on a rolling base;

FIG. 2 is a side elevation showing the mill in its tilted position;

DETAILED DESCRIPTION OF THE PREFERRED EMBODIMENT

Figure 3:
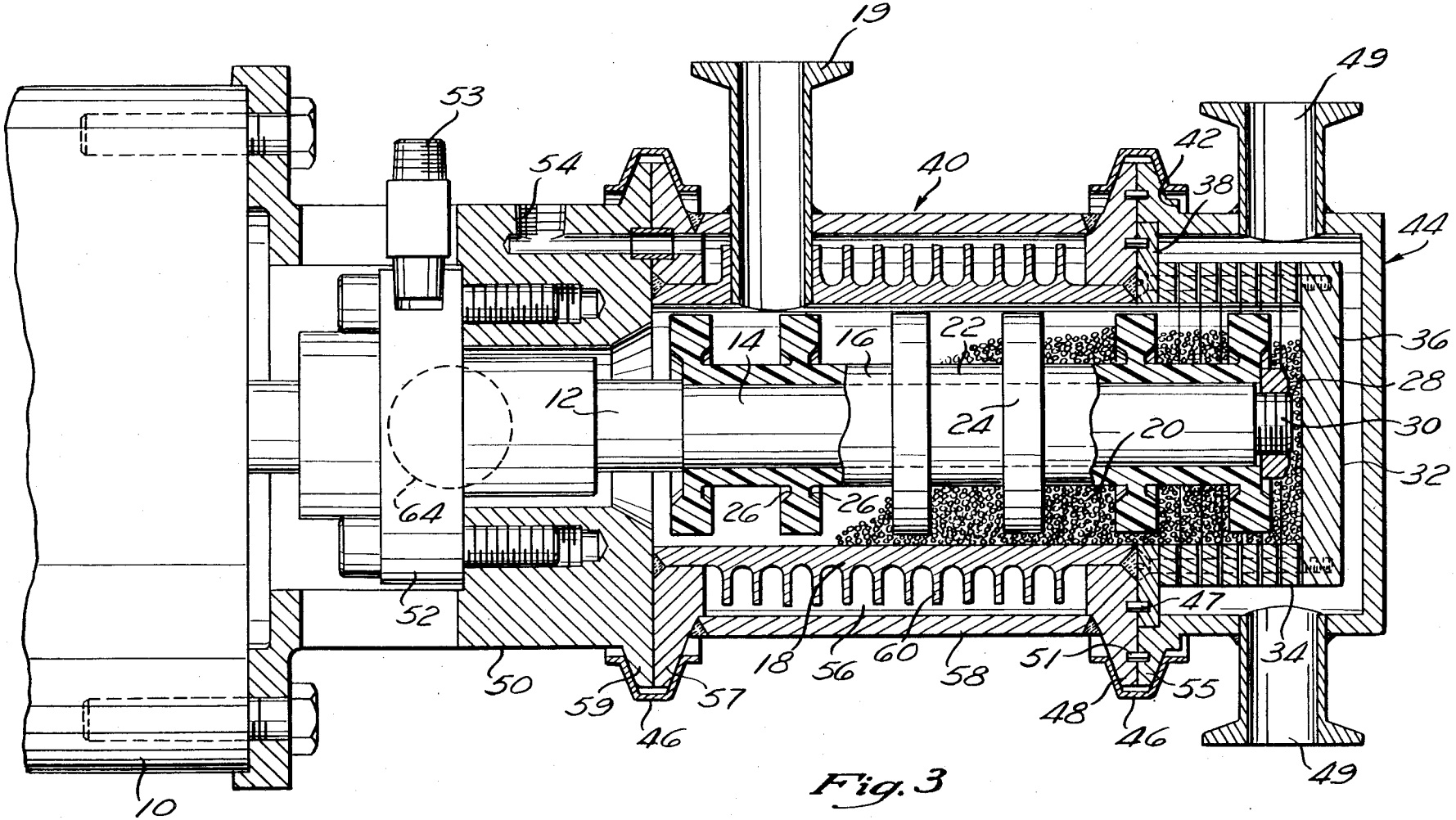
FIG. 3 is a cross-sectional view of the mill on line 3—3 of FIG. 1.

As shown in FIG. 3, the horizontal media mill comprises a mill motor 10 which has a shaft 12 which rotates a rotor 16. Preferably, the shaft 12 which drives the rotor 16 extends canvilevered directly from the mill motor 10. The portion 14 of the shaft 12 on which the rotor 16 is slideably mounted is preferably square in transverse cross section to mate with a similar opening in the rotor to prevent rotational slippage of the rotor 16. Alternatively, the shaft portion 14 and the rotor may be any symmetrical shape which has a straight portion to prevent slippage, or the rotor 16 may be keyed to the shaft 12. The rotor 16 extends through a cylindrical vessel 18, in which media 20 and product are agitated by the rotor 16. Product is introduced to the vessel through product inlet 19 at the motor end of the vessel.

The rotor 16 is preferably fabricated from a wear resistant polymer, and is machined from a solid bar of the polymer. One suitable polymer which is abrasively tougher than steel is an ultra high molecular weight polyethylene. In accordance with one feature of the invention, the fabrication process consists of drilling a pilot hole axially through the center of the bar, and then broaching a square hole through the center of the bar, surrounding the pilot hole. Alternatively, fabrication may begin with a tube of the polymer so that the first step is broaching the square cross section in the center hole of the tube. Next, the piece is turned on a lathe to be trimmed into a cylinder of a desired outside diameter. The cylinder is then cut radially to form a smaller diameter cylindrical portion 22 with a series of axially spaced, annular discs 24 which are integral with and surround the cylindrical portion 22. Finally, each disc 24 is undercut on both axial faces to create annular grooves 26 in the area where the discs 24 join the cylindrical portion 22.

The rotor is slideably mounted on the square portion 14 of the shaft 12, and is simply secured in place by a nut 28 screwed on a threaded portion 30 on the end of the shaft 12. The nut 28 is of sufficient diameter to abut the end of the rotor, so that it does not slide off the shaft.

The shaft and rotor protrude through the open end of the vessel 18, whichis enclosed by a scren mounting assembly 32. The open end of the vessel is opposite the end of the vessel adjacent the product inlet 19. The screen mounting assembly 32 is cup-shaped, and includes a tubular screen element 34, a circular end plate 36, and an annular flange 38 on the open opposite end. The milled product can pass through the screen element 34 while the media is retained in the vessel. The screen mounting assembly 32 is aligned and temporarily supported on the vessel assembly 40 by means of a plurality of dowel pins 47 positioned in the screen flange 38 and a large annular flange 48 secured to the vessel and a surrounding cylindrical outer shell 58. A cup-shaped end cover assembly 44 encloses the screen assembly 32 and is mounted to the vessel assembly 40 with a regainer ring 46 which surrounds and clamps together with a flange 55 on the cover assembly which mates with flange 48 of the vessel assembly. The end cover assembly is also retained in engagement with the vessel assembly flange 48 by dowel pins 51 in mating holes in the flanges 48 and 55.

The cover flange 55 includes a shoulder 42 which more positively holds the screen flange 38 in engagement with the vessel flange 48.

The retainer ring 46 consists of a circular ring which is split in at least one place to enable expansion, and which is fastened together at those splits by a quickly releasable fastening means, not shown. In the preferred embodiment, the retainer ring 46 is fastened by a clamp of the general type shown in the above-referenced U.S. Pat. No. 4,140,283.

The end cover assembly 40 includes a pair of diametrically spaced, upper and lower product outlets 49, through which the milled product filtering through the screen element 34 can flow.

In the preferred embodiment, the screen element forms the tubular portion of the screen mounting assembly, and is bolted at one end to the screen flange 38 and at the other end to the circular end plate 36. The screen element itself is described in the above-mentioned U.S. pending application Ser. No. 6-627,918, and comprises a plurality of annular discs, each having a central opening and a pair of opposed faces. The discs are stacked with the central openings aligned to form a cylinder having a central axis opening or channel. This channel surrounds a portion of the rotor which protrudes through the vessel. The opposed faces form a plurality of radial openings in the cylinder between adjacent discs to allow the passage of processed liquid form the vessel, or central axial openings, to the outside of the cylinder. The smallest dimension of each radial passage is small enough to prevent flow of the grinding media through the passage, so only liquid product leaves the vessel.

The vessel assembly is also removably mounted at its inlet end to a housing assembly 50 which is bolted to the mill motor 10 at one end and is coupled to the vessel assembly at the other end, encasing the shaft 12 throughout its length. Quickly removable retainer ring 46 clamps the radially extending flange 57 of the vessel assembly to the flange 59 of the housing assembly 50.

The mill further includes an integrated hydraulic system having a single electric motor 72 which drives a circulating pump 74; the working fluid pressurized by that circulating pump being utilized to cool the vessel, provide pressure up to a seal 52, drive a hydraulic motor 75 which rotates a product pump 76, and hydraulically tilt the mill when it is to be cleaned. The motor 72, circulating pump 74, motor 75, and product pump 76 are located within the base 66, as schematically shown in FIG. 1.

The vessel is sealed from the exterior by the pressure seal 52 which is a purchased cartridge that is bolted to the housing assembly 50 and surrounds the shaft 12. Pressurized working fluid is pumped into the seal 52 through a seal inlet 53 to provide a pressure greater than that on the vessel side of the seal and thus prevent leakage out of the vessel. This enables the product to be pumped through the vessel at a desired pressure and flow rate.

Pressurized fluid also acts as a coolant for the vessel by being circulated through a cooling jacket inlet 54 and into the cooling jacket 56 defined by the outer wall of the vessel 18 and the surrounding cylindrical outer shell 58. The vessel has a plurality of fins 60 protruding radially into the cooling jacket 56 to facilitate the transfer of friction generated heat within the vessel to the coolant. Not shown is a cooling jacket outlet, through which the coolant is returned to a heat exchanger 78 where it is circulated and cooled itself by cooling water, before being returned to a reservoir 77.

The pressurized working fluid from the pump 74 is also used to power a hydraulic motor 75 driving a product pump 76, which pumps the product through the vessel, thus eliminating the need for a separate electric product pump motor and associated explosion-proof switch.

The fluid also powers the hydraulic ram 62 shown in FIG. 2, which extends to tilt the mill about a trunnion 64, facilitating the cleaning of the vessel. A horizontal mill having a cantilevered shaft, as shown, is particularly suited for this tilting application. FIG. 1 shows the mill in its normal horizontal operating state, and FIG. 2 shows the mill in its tilted position. Two mounts 80 extend from the superstructure 82, on either side of the housing assembly 50. The trunnions 64 are fixed to and protrude radially outward from the sides of the housing assembly, and pivotably rest within circular holes in the mounts 80. The hydrualic ram 62 is located within the superstructure 82, and is pivotably secured to the base 66, at one end, and is pivotably secured to a motor mounting plate 68 at the other end. The motor mounting plate 68 is fastened to the mill motor 10.

Both the electric motor powering the hydraulic system and the electric mill motor are regulated by a pneumatic control system (not shown), which runs on compressed shop air. A suitable control panel 84 for controlling the operation of the system is conveniently supported on the superstructure 82. The pneumatic system saves the expense of explosion-proof electrical switches which must be used when a flammable product is being milled.

In operation, a liquid product or slurry is pumped by the hydraulically driven product pump 76 through the product inlet 19 to the vessel 18 and is dispersed throughout the grinding media 20 by the rotating rotor 16. In a small working version of the present embodiment, a single speed, 3600 rpm electric mill motor turns $2\frac{3}{4}$ inch diameter rotor discs 24 at a rim speed of 2590 ft./min. The milled product filters through the screen element 34 to the product outlet 49. Simultaneously, the vessel is being cooled by the working fluid which is circulating through the cooling jacket 56. The working fluid provides pressure to the seal 52 surrounding the shaft 12 where it enters the vessel.

When the vessel is to be cleaned, the mill is tilted about the trunnion 64 by the extension of the hydraulic ram 62, lowering the outlet end of the vessel. The end cover assembly and screen mounting assembly are then quickly removed from the vessel assembly by first unfastening the retainer ring. The pins 47 and 51 prevent the end cover and screen assemblies from both instantly falling off. To uncouple the assemblies, an axial pull on the end cover, and then the screen assembly, will dislodge the pins from their corresponding holes. The angle of the mill allows the media to conveniently drain out the then open end of the vessel, and into a suitable container 70. With the end cover and the screen assembly uncoupled, the rotor is easily withdrawn by removing the nut 28 from the threaded portion 30, sliding the rotor off the shaft to be replaced or simply temporarily removed to enable more complete access to the vessel for cleaning. The steps are reversed when the rotor is installed and the screen and end cover re-installed, and the unit returned to its horizontal position.

The grinding media is usually added through the product inlet 19, but it may also be added through the open end of the vessel when its screen is removed. In this regard, the ram 62 may be useful in tilting the vessel to distribute media. The unit may be designed to lower the motor end of the vessel slightly, if desired.

What I claim is:

1. A horizontal media mill, comprising:

a mill motor;

a shaft rotatably driven by said motor;

a rotor mounted on said shaft, said shaft and rotor having an end extending outwardly from the motor in cantilevered fashion;

a vessel surrounding said rotor and shaft in which a milling media and the product being milled are agitated by said rotor, a cup-shaped screen assembly which fits over said cantilevered end of the shaft and rotor, a cup-shaped cover assembly fitting over said screen assembly and having a product outlet, the open end of said screen assembly and the open end of said cover assembly being demountably coupled to said vessel so that the assemblies form an outlet end of the vessel, said screen assembly having a plurality of annular discs, which are stacked to form a cylinder having a central opening which surrounds the end of the rotor, and means forming a plurality of radially extending flow passages allowing milled product to flow to aid outlet, while retaining the media in the vessel, and means for tilting said vessel to lower the outlet end of the vessel to facilitate removal of said media when said screen assembly and said cover assembly are uncoupled from the vessel.

2. The media mill of claim 1, including a cooling jacket around said vessel; and an integrated hydraulic system comprising a circulator pump, a heat exchanger, and a working fluid which is circulated by said pump through said jacket and through the heat exchanger to cool the working fluid before it is recirculated through the jacket.

3. The media mill of claim 2 including a product pump which pumps the product to be milled through the vessel, said working fluid being connected to drive said mill motor and said product pump.

4. The mill of claim 3 including a seal which surrounds said shaft and which seals the product and media inside said vessel, said working fluid providing pressure to said seal to assist in maintaining the product and media in the vessel.

5. The mill of claims 2, 3 or 4 including a hydraulic ram driven by said working fluid and connected to tilt said vessel.

6. The mill of claim 1 wherein said tilting means includes a trunion on which the mill is tiltably mounted;

a hydraulic ram pivotably attached to said mill at one end and a base at the other end; and a hydraulic power system including a circulator pump which pumps a working fluid to provide power to said hydraulic ram.

7. The horizontal media mill of claim 6, further comprising:

a cooling jacket surrounding said vessel, formed by the space between said vessel and a surrounding outer shell, said working fluid being pumped through said jacket by said circulator pump to cool the vessel.

8. The mill of claim 6, further comprising:

a pressure seal surrounding said shaft where it enters the vessel to seal the product and media in the vessel, said working fluid being pumped to the exterior side of said seal to maintain the pressure on the exterior side greater than the vessel side of the seal.

9. The mill of claim 6 wherein said working fluid also drives a hydraulic motor rotating a product pump.

10. The mill of claim 1 wherein said rotor is fabricated from a suitable polymer and is formed as a cylinder surrounded by a plurality of integral, spaced, annular discs for agitating the product and media while in the vessel.

11. The mill of claim 10 wherein the rotor has a broached central opening which mounts on the motor shaft, the opening and the shaft having a flat side for causing the rotor to rotate with the shaft.

12. The mill of claim 1 wherein said end cover assembly and said screen assembly are demountably coupled to the vessel by means of a quickly removed ring-shaped retainer encircling a joint between the vessel and the end cover, with said end cover surrounding said screen assembly and retaining the screen assembly in engagement with the vessel assembly, said retainer enabling quick removal of the end cover and screen assemblies for cleaning and replacing the screen, media, and rotor, allowing easy drainage of the media upon tilting the mill to lower the outlet end of the vessel.

13. The mill of claim 1 wherein said vessel is demountably coupled to a housing at the inlet end of the vessel, said housing surrounds the shaft and extends from the motor to the vessel and is coupled to the vessel by means of a quickly removed ring-shaped retainer encircling the joint between the housing and the vessel.

* * * * *